US005205150A

United States Patent [19]

Nyffeler

[11] Patent Number: 5,205,150

[45] Date of Patent: Apr. 27, 1993

[54] IRRIGATION-PIPE DENT-REMOVAL TOOL AND METHOD

[76] Inventor: Mark R. Nyffeler, R.R. 4 (Box 23), Columbus, Nebr. 68601

[21] Appl. No.: 933,816

[22] Filed: Aug. 24, 1992

[51] Int. Cl.[5] ..... B21D 3/14

[52] U.S. Cl. ..... 72/454; 72/304

[58] Field of Search ..... 72/454, 705, 304, 308

[56] References Cited

U.S. PATENT DOCUMENTS

| | | | |
|---|---|---|---|
| 3,977,230 | 8/1976 | Jones | 72/705 |
| 4,445,264 | 5/1984 | Banerian | 72/454 |
| 4,495,687 | 1/1985 | Sieveking | 72/454 |
| 4,519,235 | 5/1985 | Gauck | 72/454 |
| 4,761,987 | 8/1988 | Gamauf | 72/705 |

*Primary Examiner*—David Jones

*Attorney, Agent, or Firm*—George R. Nimmer

[57] ABSTRACT

The prior art teaches agricultural irrigation-pipes extending horizontally along and circularly surrounding a central-axis and provided with a sideward water delivery-opening and adjacently oftentimes being inflicted with inimicable dents that interfere with gating mechanism for the water delivery-opening. Herein disclosed is irrigation-pipe dent-removal tool and method which remove inimicable dents of the irrigation-pipe. The irrigation-pipe dent-removal tool includes a rear-plate confrontably abuttable at the irrigation-pipe inside-surface dents bulging and manually pullable thereagainst with an attached flexible cable, and further includes a front-plate (slidably surrounding the elongate flexible cable) confrontably abuttable at the irrigation-pipe outside-surface, and finally including threaded bolts (or the equivalent) for controllably drawing together the rear-plate and the front-plate to pressurably remove the inimicable dents of the intervening irrigation-pipe.

5 Claims, 1 Drawing Sheet

IRRIGATION-PIPE DENT-REMOVAL TOOL AND METHOD

BACKGROUND OF THE INVENTION

Drawing FIGS. 1 and 2 are side-elevational and sectional-elevational views, respectively, of a Prior Art irrigation-pipe 100 that lengthily longitudinally extends along a central-axis 100A and which includes an outside-surface 101 concentrically surrounding (at outside-radius R1) central-axis 100A and an inside-surface 102 concentrically surrounding (at inside-radius R2) central-axis 100A. Irrigation-pipe 100 is provided with a sideward water delivery-opening 100W that is controllably gateable (such as with a gate disclosed in U.S. Pat. No. 2,901,211 (Epp-Aug. 25, 1959), or equivalent gating means). However, whenever such irrigation-pipe 100, adjacent to its sideward delivery-opening 100W, becomes physically dented (100D) during usage, such one or more dents (100D) inimicably interfere with the gating means thereat. Because each such irrigation-pipe inimical dent (100D) is exhibited as a bulge at the irrigation-pipe inside-surface, and there neither viewably discernible nor mechanically treatable at the irrigation-pipe outside-surface 101, the prior art workers have been frustrated from the quest to remove such irrigation-pipe inwardly-extending (102) inimicable dents 100D.

GENERAL OBJECTIVE OF THE INVENTION

In view of the foregoing, it is the general objective of the present invention to provide a tool and means method for removing one or more inimicable irrigation-pipe dents and which tool and method are easy to employ and adequate for the purpose of sufficiently removing the irrigation-pipe dents so that the irrigation-pipe can be controllably gated with a selectable conventional gate.

GENERAL STATEMENT OF THE INVENTION

With the above general objective in view, and together with other ancillary and specific objectives which will become more apparent as this description proceeds, the irrigation-pipe dent-removal tool and method of the present invention generally comprises: providing along the irrigation-pipe inside-surface and abuttably against said at least one dent, and in surrounding relationship to the water delivery-opening thereof, a rear-plate including a linearly-generated leadward-surface positionable at a constant leadward-radius from said central-axis, said rear-plate being centrally provided with a flexible cable extending outwardly through said water delivery-opening; providing along the irrigation-pipe outside-surface and alongside said at least one dent and in surrounding relationship to said water delivery-opening, a front-plate including a linearly-generated concave trailward-surface positionable at a constant trailward-radius from said central-axis and which trailward-radius exceeds said leadward-radius, and said front-plate slidably surrounding said elongate flexible cable; and, extending through said irrigation-pipe water delivery-opening, threaded fasteners (or equivalent means) for controllably drawing together said rear-plate and front-plate, whereby said drawn-together rear-plate and front-plate pressurably remove at least one inimicable dent from said dented irrigation-pipe.

BRIEF DESCRIPTION OF THE DRAWING

In the drawing, wherein like characters refer to like parts in the several views, and in which.

Drawing FIGS. 1 and 2, aforedescribed, refer to a prior art irrigation-pipe (100) having a sideward water delivery-opening (100W) and inflicted with one or more inimicable dents (100D).

Drawing

Drawing

Drawing

Drawing

DETAILED DESCRIPTION OF THE DRAWING

Figure 1:
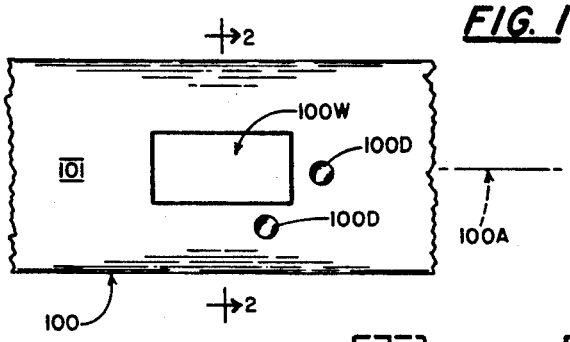
FIG. 1 (PRIOR ART)
Figure 2:
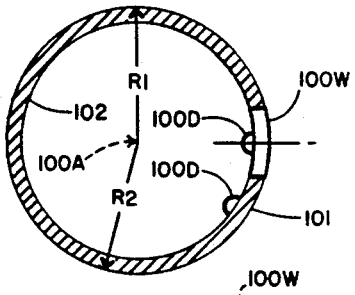
FIG. 2 (PRIOR ART)
Figure 7:
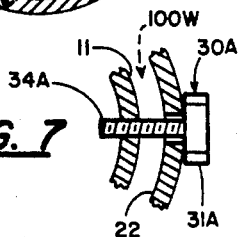
FIG. 7 is a sectional elevational view taken along line 7—7 of FIG. 5.

Representative embodiment 9 of the irrigation-pipe dent-removal tool of the present invention generally comprises: a rear-plate 10 having a linearly-generated convex leadward-surface 11 abuttable against the irrigation-pipe dent-inflicted (100D) inside-surface 102 and being centrally provided with a flexible cable 15 outwardly extendable through the irrigation-pipe sideward water delivery-opening 100W; a front-plate 20 slidably (23) surrounding said cable 15 and including a linearly-generated concave trailward-surface 22 abuttable against the irrigation-pipe dent inflicted (100D) outside-surface 101; and, extendable through the irrigation-pipe delivery-opening 100W, inter-plates drawing means (e.g. threaded bolts 30A, 30B) for drawing rear-plate 10 toward front-plate 20 and the plates'-intervening irrigation-pipe 100, whereby the drawn-together rear-plate and front-plate squeeze the intervening dent-inflicted irrigation-pipe to pressurably remove said at least one inimicable dent (100D) from the irrigation-pipe.

Preferred embodiments for the synergistically interrelated rear-plate, front-plate, and inter-plates drawing means for the irrigation-pipe dent-removal tool are treated in the ensuing paragraphs, namely, as follows:

Metallic rear-plate 10 has a linearly-generated convex leadward-surface 11 located a constant leadward-radius that dimensionally approximates irrigation-pipe inside-radius R2, and a trail-surface 12. Trail-surface 12 is preferably of linearly-generated concave configuration and arcuately paralel to its arcuate leadward-surface 11. Rear-plate 10 is forwardly pullable (i.e. toward its leadward-surface 11 and irrigation-pipe inside-surface 102) with a rear-plate centrally-associated elongate flexible cable 15. Herein, flexible cable 15 is slidably surrounded (at 13) by rear-plate 10, and has a cable trail-enlargement 16 abuttable against rear-plate trail-surface 12.

Metallic front-plate 20 has a linearly-generated concave trailward-surface 22 located a constant trailward-radius that dimensionally approximates irrigation-pipe outside-radius R1, and a lead-surface 21. Said trailward-radius dimensionally exceeds said leadward-radius. Lead-surface 21 is preferably of linearly-generated convex configuration and parallel to trailward-surface 22.

The preferred inter-plates drawing means comprises:

(i) for rear-plate 10, and in flanking relationship to its outwardly extending cable location (13, 15), threaded holes 14A and 14B, each such threaded hole intersecting rear-plate surfaces 11 and 12;

(ii) for front-plate 20, and in flanking relationship to its slidably surrounded cable location (23, 15), relatively enlarged non-threaded holes 24A and 24B that are in registry, respectively, with said threaded holes 14A and 14B; and (iii) extendable through; said irrigation-pipe sideward delivery-opening 100W; said non-threaded holes 24A and 24B; and threadedly engaged with threaded holes 14A and 14B, respectively, bolts threaded bolts 30A and 30B serving as inter-plates drawing means.

Figure 3:
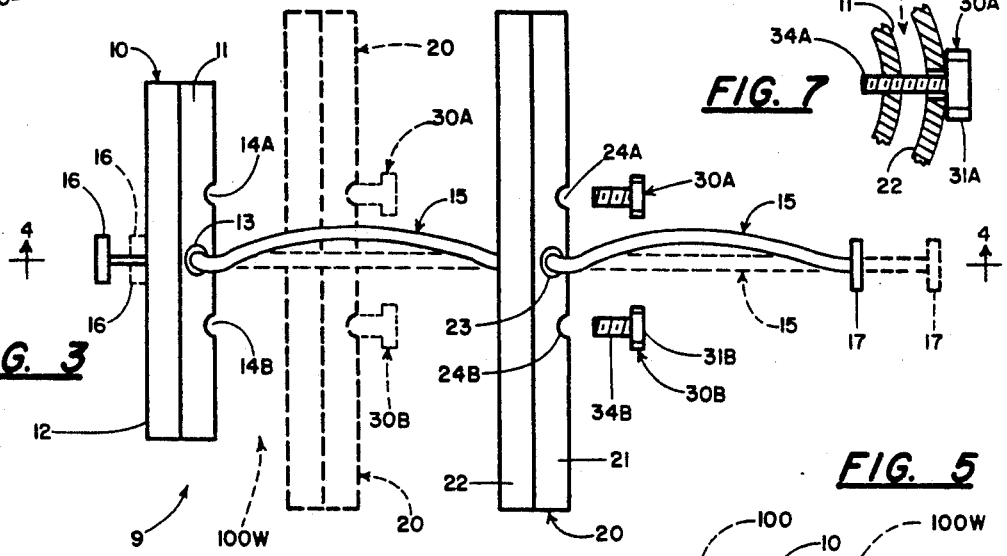
FIG. 3 is a top plan view of a representative embodiment (9) of the irrigation-pipe dent-removal tool of the present invention, the bottom plan view (not shown) being a mirror image thereof.
Figure 5:
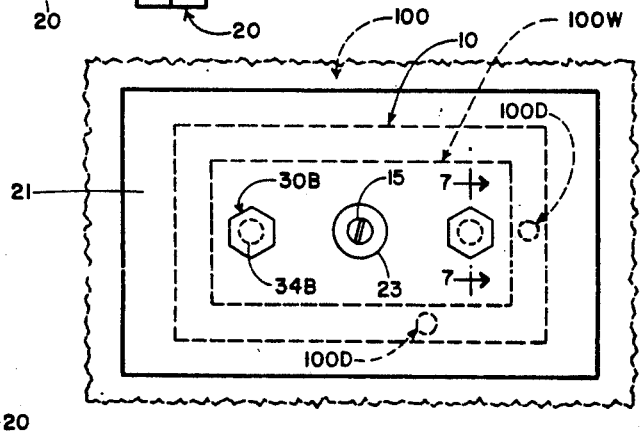
FIG. 5 is a sectional elevational view taken along arcuate line 5—5 of FIG. 4.
Figure 4:
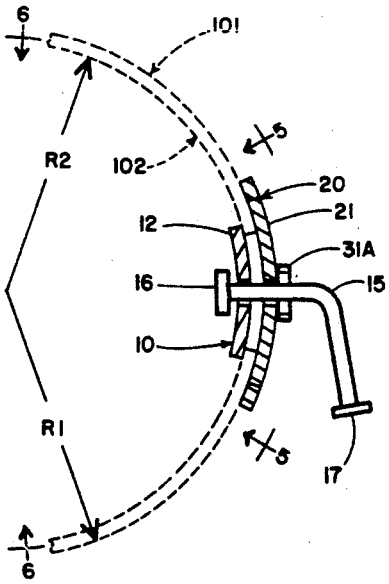
FIG. 4 is a sectional elevational view taken along line 4—4 of FIG. 3 and shown installed with an appropriate environment (i.e. in phantom lines, the FIGS. 1 and 2 irrigation-pipe 100)
Figure 6:
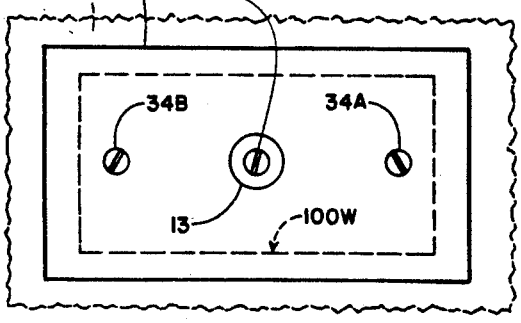
FIG. 6 is a sectional elevational view taken along arcuate line 6—6 of FIG. 4; and Drawing

Accordingly, in view of the explanation contained in the immediately preceeding sub-paragraphs (i), (ii), and (iii), a preferred embodiment (9) for the irrigation-pipe dent-removal tool is functionable, for the purposes of pressurably removing inimicable irrigation-pipe dents (100D), according to the following method steps therefor:

(a) inserting tool rear-plate 10 within irrigation-pipe sideward water delivery-opening 100W, and pulling upon its associated cable (i.e. at cable leadward handle 17) so that (as indicated in FIG. 3 phantom lines) rear-plate leadward-surface 11 surrounds delivery-opening 100W and in abutting relationship to irrigation-pipe inside-surface 102 and dent bulges 100D thereat;

(b) sliding front-plate 20 along cable 15 so that (as indicated in FIG. 3 phantom lines) front-plate trailward-surface 22 surrounds delivery-opening 100W and in abutting relationship to irrigation-pipe dent depressions 100D thereat; and (c) engaging threaded bolt 30A through front-plate non-threaded hole 24A, through rear-plate threaded hole 14A (via delivery-opening 100W), and also engaging threaded bolt 30B (having head 31B and threaded shank 34B) through front-plate non-threaded hole 24B, and through rear-plate threaded hole 14B (via delivery-opening 100W). Thus, according to the instant sub-paragraph (c), plates 10 and 20 are controllably threadedly drawn together against the intervening dents-inflicted irrigation-pipe, whereby the dents (100D) are pressurably removed from the irrigation-pipe 100. Accordingly, one the irrigation-pipe dents (100D) are thusly removed by tool 9, a conventional irrigation-pipe gate can be reliably installed at its sideward water delivery-opening (100W).

From the foregoing, the construction, operation, and usage of the irrigation-pipe dent-removal tool of the present invention will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

I claim:

1. For the environment of an agricultural irrigation-pipe extending lengthily along a central-axis and having an inside-surface located a finite inside-radius from said central-axis and having an outside-surface located a finite outside-radius from said central-axis, said irrigation-pipe having a sideward water delivery-opening therethrough and which is adjacently inflicted with at least one inimicable irrigation-pipe dent, each dent being exhibited as a depression at the irrigation-pipe outside-surface and as a bulge at the irrigation-pipe inside-surface, an irrigation-pipe dent-removal tool and comprising:

(A) a rear-plate including a linearly-generated convex leadward-surface having a constant leadward-radius and being centrally provided with a flexible cable extending outwardly away from said leadward-surface and through the sideward water delivery-opening for a said irrigation-pipe;

(B) a front-plate centrally slidably surrounding said flexible cable and including a linearly-generated concave trailward-surface having a constant trailward-radius that dimensionally exceeds said rear-plate leadward-radius; and (C) extendable through said irrigation-pipe sideward water delivery-opening, inter-plates drawing means for controllably tightly drawing together said rear-plate and said front-plate, whereby said drawn-together rear-plate and front-plate squeeze the dent inflicted irrigation-pipe and pressurably remove said at least one dent from said irrigation-pipe.

2. The irrigation-pipe dent-removal tool of claim 1 wherein said inter-plates drawing means comprises: said rear-plate, and in flanking relationship to said engaged flexible cable, is provided with threaded holes therethrough; said front-plate, and in flanking relationship to said slidably surrounded cable and in registry with said rear-plate threaded holes, is provided with relatively enlarged non-threaded holes; and wherein threaded bolts respectively extend through one said non-threaded hole of the front-plate and is threadedly engaged with a threaded hole of the rear-plate.

3. The irrigation-pipe dent-removal tool of claim 1 wherein said rear-plate is provided with a linearly-generated concave trailward-surface; wherein said front-plate is provided with a linearly-generated leadward-surface; and wherein said flexible cable has a leadward-end positioned outwardly beyond said front-plate, said cable being leadwardly provided with a manually engageable handle, whereby when said handle is manually pulled outwardly away from said front-plate, said rear-plate leadward-surface can be abuttably held against the irrigation-pipe inside-surface preparatory to utile engagement of the inter-plates drawing means.

4. For the environment of an irrigation-pipe lengthily extending along a central-axis and having therealong an inside-surface circularly surrounding said central-axis and located a finite inside-radius (R2) from said central-axis and also an outside-surface concentrically surrounding and located a finite outside-radius (R1) from said central-axis, said irrigation-pipe being provided with a water delivery-opening therethrough and which is adjacently provided with at least one inimical irrigation-pipe dent, each dent being exhibited as a depression at the irrigation-pipe outside-surface and also being exhibited as a bulge at the irrigation-pipe inside-surface, a method for removing said one or more inimical irrigation-pipe dents and comprising the following method steps:

(A) providing along the irrigation-pipe inside-surface and alongside said at least one dent and in surrounding relationship to the water delivery-opening thereof, a rear-plate including a linearly-generated convex leadward-surface disposed at a constant leadward-radius from said central-axis, said rear-plate being centrally provided with a flexible cable extending outwardly through said water delivery-opening;

(B) slidably along said flexible cable and providing along the irrigation-pipe outside-surface and alongside said at least one dent and in surrounding relationship to the water delivery-opening thereof, a front-plate including a linearly-generated concave trailward-surface disposed at a constant trailward-radius from said central-axis and which exceeds said constant leadward-radius, said front-plate slidably surrounding said elongate flexible cable; and (C) controllably tightly drawing together said rear-plate and said front-plate whereby the intervening dent inflicted irrigation-pipe is squeezed by said drawn-together rear-plate and front-plate and the at least one dent of the intervening irrigation-pipe is pressurably removed.

5. The irrigation-pipe dent-removal tool of claim 3 wherein said inter-plates drawing means comprises: said rear-plate, and in flanking relationship to said associated flexible cable, is provided with threaded holes therethrough; said front-plate, and in flanking relationship to said slidably surrounded cable and in registry with said rear-plate threaded holes, is provided with relatively enlarged non-threaded holes; and wherein threaded bolts respectively extend through one non-threaded hole of the front-plate, thence through the irrigation-pipe sideward water delivery-opening, and thence threadedly engaged with one said aligned threaded hole of the rear-plate.

* * * * *